US006349530B1

(12) United States Patent
Stahlecker

(10) Patent No.: US 6,349,530 B1
(45) Date of Patent: Feb. 26, 2002

(54) PROCESS AND APPARATUS FOR CONTROLLING COPS OF RING SPUN YARN DEPENDENT ON A YARN HAIRINESS

(75) Inventor: Fritz Stahlecker, Josef-Neidhart-Strasse 18, 73337 Bad Überkingen (DE)

(73) Assignees: Fritz Stahlecker, Bad Überkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/413,787

(22) Filed: Oct. 7, 1999

(30) Foreign Application Priority Data

Nov. 2, 1998 (DE) ..... 198 50 413
Apr. 26, 1999 (DE) ..... 199 18 780

(51) Int. Cl.[7] ..... D01H 7/52

(52) U.S. Cl. ..... 57/75; 57/264; 57/265; 57/266; 57/276; 57/281; 57/328

(58) Field of Search ..... 57/264, 265, 266, 57/276, 281, 328; 198/350; 242/35.5 A, 475.8

(56) References Cited

U.S. PATENT DOCUMENTS 4,785,618 A * 11/1988 Stahlecker ..... 57/264
4,843,808 A * 7/1989 Ruge et al. ..... 57/264
5,056,725 A * 10/1991 Wirtz et al. ..... 242/35.5
5,600,872 A 2/1997 Artzt et al.
6,061,127 A * 5/2000 Pirani ..... 356/238.2

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

In the case of ring spinning with condensing devices there is a risk that the yarns of the individual cops have a varying degree of hairiness. This can result in faults in the end product, for example a woven fabric. In order to avoid such faults, the ring spinning machine is connected to a monitoring station, in which the yarns are automatically monitored for hairiness; the cops, based on the monitoring results, are then automatically sorted.

51 Claims, 5 Drawing Sheets

63
62
65
52
25
h'
i'
j'
h"
i"
k'

PROCESS AND APPARATUS FOR CONTROLLING COPS OF RING SPUN YARN DEPENDENT ON A YARN HAIRINESS

BACKGROUND AND SUMMARY OF THE INVENTION

This application claims the priority of German application 198 18 780.0, filed in Germany on Nov. 2, 1998, and German application 199 18 780.0 filed in Germany on Apr. 26, 1999, the disclosures of which are expressly incorporated by reference herein.

The present invention relates to a process for monitoring the hairiness of yarns, spun on ring spinning machines comprising condensing devices and wound onto cops, and for initiating various measures dependent on the hairiness ascertained.

Ring spinning machines comprising condensing devices are prior art in, for example, U.S. Pat. No. 5,600,872. Condensing devices of this type are located at each spinning station directly downstream of the respective drafting arrangement in a zone, to which the spinning twist imparted by the ring spindle does not retroact. The particular feature of yarn spun on ring spinning machines comprising condensing devices is the low hairiness. Differing degrees of hairiness can be ascertained just by visually comparing two cops.

By means of the condensing device, outwardly projecting edge fibers of the drafted fiber strand are rolled pneumatically around the core strand, which results in the fiber strand being condensed. If the fiber strand has been condensed well, no fiber triangle occurs at the last nipping line, to which point the spinning twist returns. In contrast thereto, in the case of a standard ring spinning machine without condensing device, there is a fiber triangle present. In this case the edge fibers are not sufficiently rolled in, and thus a hairy yarn arises. The wider the fiber triangle is, the hairier the yarn.

If, for some reason, condensing does not, or does not fully, take place in the case of ring spinning with condensing devices, an undesirable fiber triangle occurs at the respective spinning station. Such defects cannot unfortunately be eliminated by means of pneumatic condensing, as suction devices may become blocked by fiber fly, or fiber fly may settle in the suction openings present in a condensing device, so that the desired condensing does not takes place in the desired way. This is in particular the case when dirty cotton is processed, in particular when it contains so-called honeydew.

Cops which are formed from such faulty spinning stations are extremely dangerous. Mixed in with good cops, they can result in faults in the end product, for example a woven fabric, which can render the product unmarketable. The otherwise even product becomes streaked, or the so-called Moir effect can arise due to the differing degrees of hairiness. Different degrees of hairiness can result in uneven color when dyeing. An increased hairiness in the yarn of a single cop can cause a whole batch of woven fabric to be rejected.

In spinning mills using ring spinning machines comprising condensing devices, the individual cops were up to now manually examined and the unusable ones rejected. This process is not economically viable in the case of mass production of yarns.

It is an object of the present invention therefore to make the process for monitoring the hairiness in ring spinning machines comprising condensing devices of the above mentioned type more economically viable and to ensure that for one and the same end product only cops having yarns without varying degrees of hairiness are used.

This object has been achieved in accordance with the present invention in that at least one monitoring station is connected to the ring spinning machine, in which monitoring station the yarn is automatically checked for hairiness and the cops are automatically sorted out according to the monitoring results.

By applying the process according to the present invention, the yarn of each individual cop is monitored. A monitoring station of this kind functions preferably optically and is so designed that each cop, for example, stands out well from a dark background wall, so that outwardly projecting hairs are easily recognized by the monitoring station.

The process can be particularly easily carried out when the cops are monitored during transport away from the ring spinning machine according to certain preferred embodiments of the invention. Monitoring must occur at the latest before the cops are re-wound to cross-packages and could, in certain circumstances, even take place at the winding machine. The cops transported away from the ring spinning machine can be transported to travel through a monitoring station. According to the degree of hairiness, the cops can then be individually rejected or classified.

Although monitoring can be carried out while the cops are travelling, it is particularly advantageous according to certain preferred embodiments of the invention when the cops are guided through the monitoring station by means of a preferably sequenced-motion transport device, for example peg trays. The further transportation of the peg trays from the ring spinning machine occurs, as a rule, periodically, whereby in each sequence the cops come to a short standstill. This short standstill is sufficient time for the optical monitoring of the cops by means of a light flash. If the monitoring station is too slow, a plurality of monitoring stations can be activated one after the other with each monitoring station being given the function to check the cop only at a certain point. It is important in this respect that the monitoring station ascertains from which spinning station of the ring spinning machine the respective cop comes.

When the cops are being monitored during a standstill, it is purposeful to set up a buffer zone between the ring spinning machine and the winding machine according to certain preferred embodiments of the invention. By these means, more monitoring stations can be arranged adjacent to one another, into which the cops can be placed. They can then remain there for some seconds and subsequently be transported further by the transport device. When a plurality of cops are monitored at the same time, a short standstill, which is longer than the sequence time of the transporting device, does not have a negative effect.

A buffer zone during a peg tray transport can also be realized in that the closed chain of the peg tray row is broken by a gap, and that in the area of this gap, the transport of several peg trays, for example six, is accelerated by means of a rapid motion according to certain preferred embodiments of the invention. These six peg trays have at their disposal an extended dwell time, namely until the gap is closed again by the normal peg tray transport. This is explained in more detail below in the description of the Figures.

Spinning cops having an undesirably high degree of hairiness must not necessarily be rejects. In a further feature of preferred embodiments of the present invention, the cops can be classified according the degree of hairiness and used for various purposes. The sorting of the cops takes place hereby according to various monitoring criteria. In the case of a very important and high quality batch, for example, the monitoring station is adjusted to be more exact than for a normal batch. For a product of particular quality, different standards of quality could be classified, and only the very bad quality cops would be rejected as unusable.

In particular in the case of link systems between ring spinning machines and winding machines, removing cops which appear unsuitable from the transporting device presents no difficulties. It is possible for removal from the transporting device to take place at a later point in time, that is at the winding machine, according to certain preferred embodiments of the invention. What is important is that either the cop is accordingly marked, or the computer knows, by means of counting, at which point of the transporting device a bad cop is located.

In practice it is provided that the faulty spinning stations are identified retroactively and indicated by a computer according to certain preferred embodiments of the invention. At the latest at the winding machine, advantageously however before that, the spinning stations of the ring spinning machine which have created a yarn which is too hairy are ascertained and indicated. When a spinning station has been indicated as being qualitatively bad, the operating personnel must be informed in a suitable way, for example by way of a number indicator or by the lighting of a control lamp at the respective spinning station. The operating personnel can then check whether suction openings or other places in the revelant condensing device are no longer sufficiently air permeable.

Monitoring in the monitoring station should be carried out regardless of the degree of fullness of the cops according to certain preferred embodiments of the invention. The possibility exists that a yarn is differently hairy at the beginning of a spinning operation or at its end. This can be ascertained in the monitoring station when a cop is tested for hairiness over its entire length.

It is purposeful when the cop is rotated around its axis in the monitoring station according to certain preferred embodiments of the invention. Thus gives still more reliable values. For example, a small auxiliary motor could, by means of a friction wheel, cause the supporting device of the respective cop to rotate.

After the cops have been produced, there is always the risk that the hairs present are pressed on by means of a component or by manual contact. In order that the monitoring results are not falsified, it is provided in a further feature of preferred embodiments of the present invention that a stream of air is passed over the cops in to order to make the hairs stand up in the monitoring station.

The hairiness of the yarn does not necessarily have to be monitored in a wound state of the cops according to certain preferred embodiments of the invention. The monitoring station can function in such a way that a sufficiently long piece of yarn for monitoring is taken off the wound cop. The cop is then processed further thereafter. This type of monitoring is, however, when it takes place outside of the winding machine, more complicated than the monitoring of the cop itself.

Alternatively, according to certain preferred embodiments of the invention, the yarn can be also only tested for hairiness at the winding machine during rewinding, as long as it is certain that the defect spinning stations are detected by suitable means. The yarns can, in this case, travel through a monitoring station at each work station of the winding machine, which monitors the respective yarn for hairiness. Thus no time loss occurs, as the yarns are wound off the cops anyway during rewinding.

In another process according to the present invention, the yarns are already monitored for hairiness during the spinning process, advantageously by means of a maintenance device which travels along the length of the ring spinning machine, to which maintenance device the monitoring station is applied. In ring spinning, a so-called yarn balloon occurs, on which, under the action of the occurring centrifugal forces, the hairs spread so that they can be seen very clearly. When a stroboscope is arranged at the monitoring station, the yarn balloon appears to the monitoring station to stand still. This results in the monitoring station having sufficient time for monitoring. In addition, the yarn is monitored repeatedly in this process during a cop winding. Finally, the spinning process can be stopped on the spot if required in the case of inadmissible hairiness.

There are monitoring devices already on the market for measuring hairiness, which have never been connected with a ring spinning machine up to now. These measuring devices function using, for example, a digital camera, whose signals are taken up by a computer and analyzed, or by means of line diodes, whose values are processed by a computer.

For the process according to certain preferred embodiments of the present invention, a digital camera, the principles of which are known, is advantageously used, in which a computer, designed expressly for image evaluation, is integrated. The computer comprises a plurality of entries and exits, by means of which the monitoring station can be controlled. The digital camera is programmed in such a way that it functions as though a plurality of line diodes were laid out together at certain distances. The camera is arranged on the one side of the thread or cop, and the necessary lighting on the other side of the thread or the cop.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
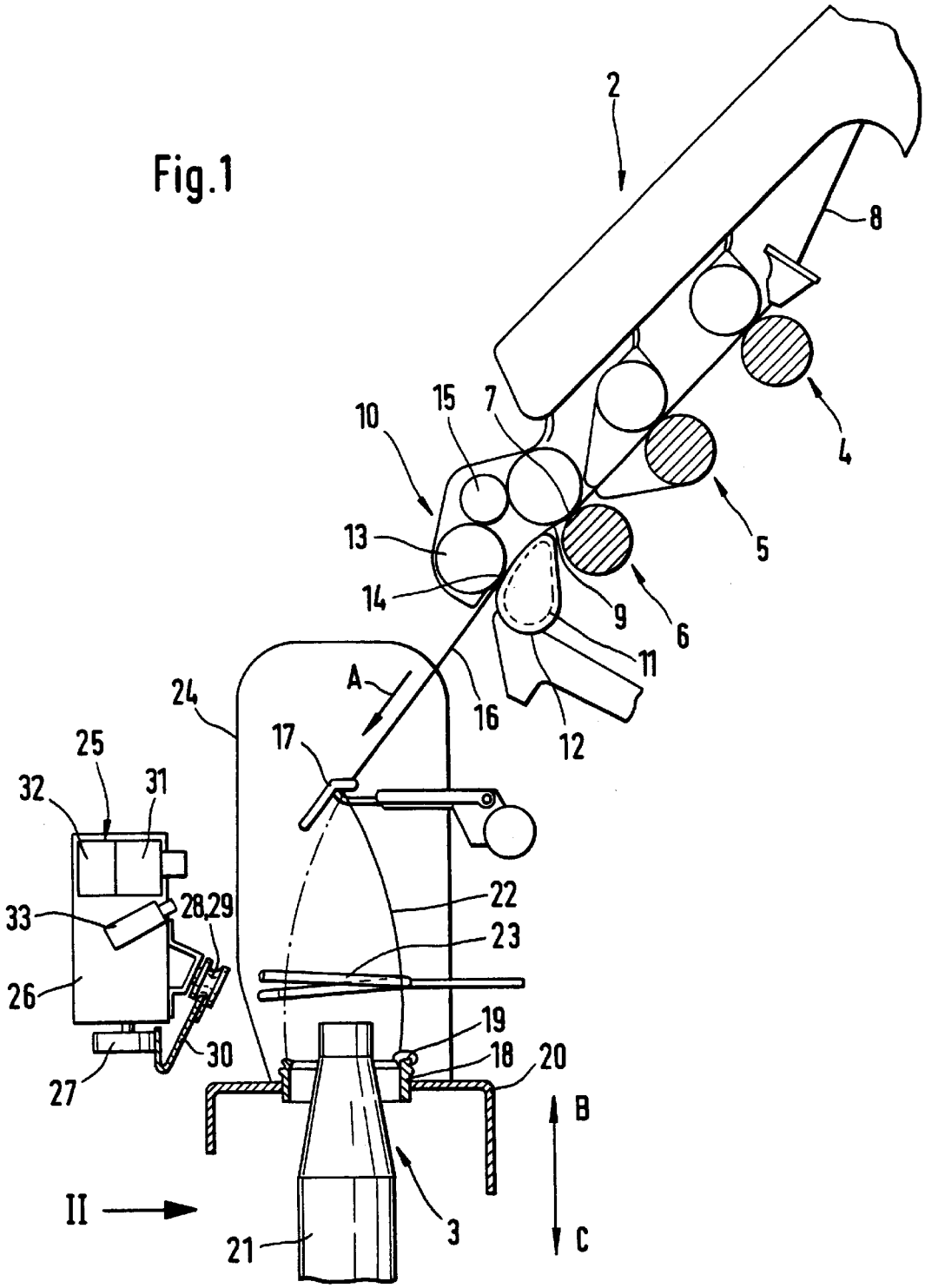
FIG. 1 is a partly sectional side view of a spinning station of a ring spinning machine, at which a maintenance device comprising a monitoring station constructed according to preferred embodiments of the invention is currently active.
Figure 2:
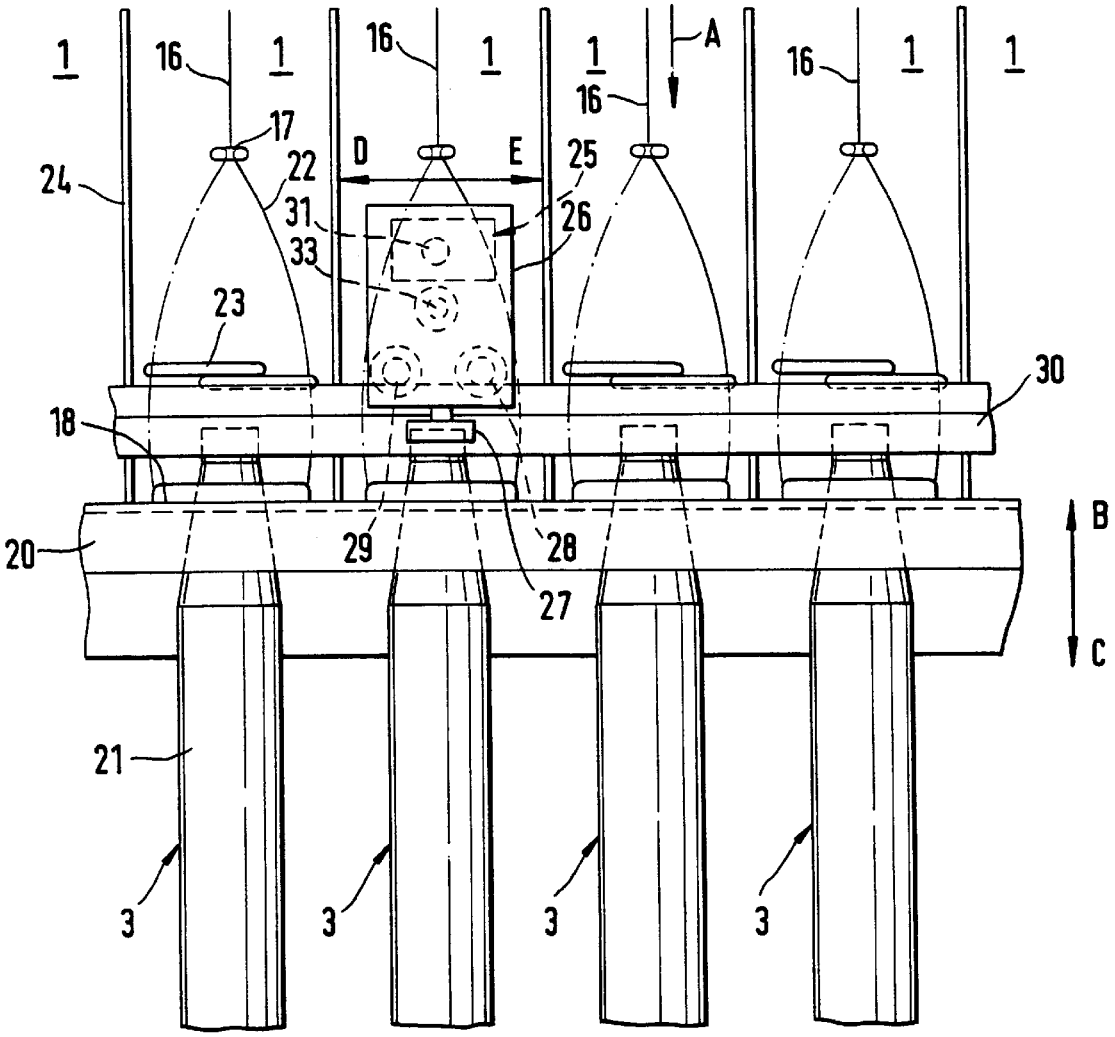
FIG. 2 is a view in the direction of the arrow II of FIG. 1, whereby the drafting arrangement is omitted.

As shown in FIGS. 1 and 2, a ring spinning machine is partly shown, in which a plurality of spinning stations 1 are arranged adjacently in a row on both machine sides. Each spinning station 1 comprises among other components a drafting arrangement 2 and a spindle 3.

An entry roller pair 4 is part of the drafting arrangement 2, as is a center roller pair 5 in the form of an apron roller pair and also a front roller pair 6 forming a front nipping line 7. A sliver or roving 8 is drafted in a known way to the desired fineness in the drafting arrangement 2.

Downstream of the front nipping line 7 lies a drafted but as yet still twist-free fiber strand 9. This travels through a condensing device 10, in which the fiber strand 9 is bundled by means of condensing and thus becomes smaller in cross-section. The condensed fiber strand becomes therefore less hairy and more tear-resistant overall. In the case of the condensing device 10, any of the condensing arrangements known as prior art up to now can principally be involved.

In the case of the condensing arrangement 10 shown here, a suction tube 11 is present, which is aligned opposite to the fiber strand 9 to be condensed and has a suction slit extending in transport direction. A sieve belt 12 transports the fiber strand 9 over the suction tube 11 to the nipping roller 13, which together with the suction tube 11 forms a delivery nipping line 14, from which point the fiber strand 9 is no longer condensed. The nipping roller 13 is driven by means of an transfer roller 15 by the front roller pair 6.

Downstream of the delivery roller line 14 a yarn 16 is present which is provided with a twist and has a very low degree of hairiness, as is so desired. The yarn 16 travels in delivery direction A to the spindle 3 via a balloon thread guide 17 (so-called pigtail) and a ring traveller 19 circulating on a spinning ring 18. The spinning ring 18 is applied to a ring rail 20 extending in machine longitudinal direction and traverses according to the traversing directions B and C. Thus the spun yarn 16 is wound onto a cop 21 in a known way.

Between the balloon thread guide 17 and the ring traveller 19, a balloon-like rotating yarn piece 22 arises when the spindle 3 rotates, which yarn piece 22 is checked somewhat by means of an anti-ballooning device 23. Furthermore, so-called separators 24 are located between two spindles 3.

In the case of spinning stations 1 having a condensing device 10, there is not always a guarantee that the perforation of the sieve belt 12 or the suction tube 11 do not become partly covered in fiber fly. It can happen that the arising yarn 16 is hairier than it should be. A fault of this type can have such a negative effect in a subsequent process, for example in weaving, that the product becomes unmarketable. For example, as a result of varying degrees of hairiness of the yarns 16 of a single cop 21, the feared moir( effect can occur in a woven fabric. Cops 21 having varying degrees of hairiness of the yarns 16 should be removed in time.

In order that ascertaining of the hairiness does not have to take place subjectively by means of visual inspection, it is provided according to the present invention that a monitoring station 25 is provided at the ring spinning machine, in which the yarns 16 are automatically monitored for hairiness and the cops 21 are automatically removed based on the findings of the monitoring station 25.

In the embodiment according to FIGS. 1 and 2, the monitoring station 25 is applied to a maintenance device 26, which travels along the row of spinning stations 1 according to the travel directions D and E. The maintenance device 26 comprises for this purpose running wheels 27,28 and 29, which run on rails 30. The drive can be effected for example by means of a traversing tension belt.

The monitoring station 25 comprises for example a digital camera 31 having an integrated computer 32 for analyzing the findings. A stroboscope 33 is also advantageously arranged to the monitoring device 25, which illuminates the balloon-like circling yarn piece 22 in such a way that it appears to be at a standstill. The hairs on the yarn 16 become thus easily visible, especially as the centrifugal forces in the area of the balloon-like, circling yarn piece 22 ensure that the hairs stand out.

The findings of the monitoring device become more exact the nearer the digital camera 31 is advanced towards the balloon yarn guide 17. The balloon-like circling yarn piece 22 hardly breathes at all in this area.

A completely different embodiment according to the present invention is described below with the aid of FIGS. 3 to 5.

Figure 3:
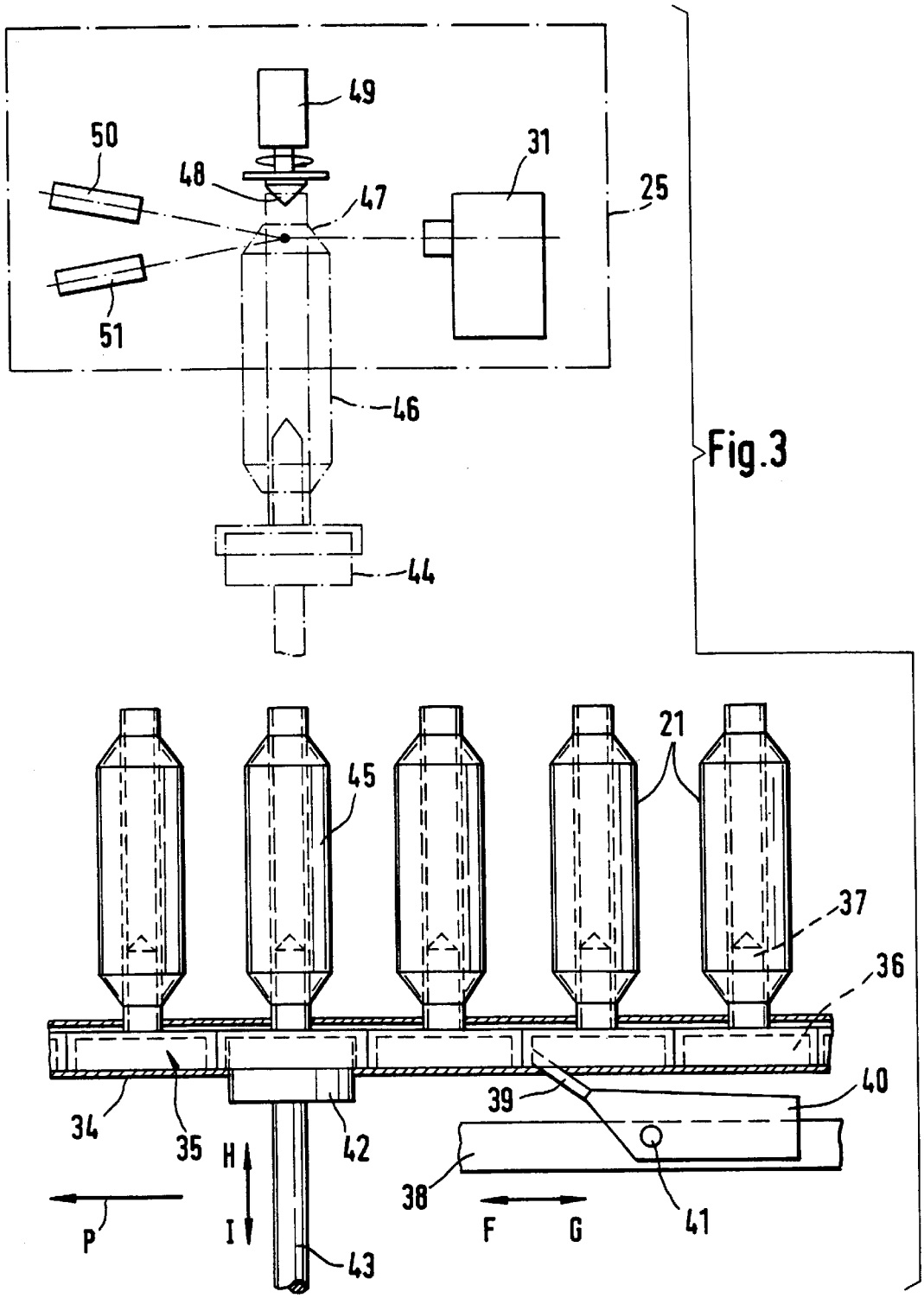
FIG. 3 is a partial enlarged view onto a peg tray row which is being guided through a monitoring station constructed according to preferred embodiments of the invention.

In FIG. 3 a longitudinal rail 34 is shown which extends along the ring spinning machine, on which longitudinal rail 34 so-called peg trays 35, with cops 21 located thereon, run in a known way. The peg trays 35 comprise each a tray 36, which is guided in the longitudinal rail 34, as well as a short peg 37 for taking up a cop 21. The cops 21 are placed on the peg trays 35 after a doffing operation, when they have been taken off their respective spindles 3. It is provided in the known way that at all spindles 3 of a machine row all cops 21 are jointly removed to be replaced with new empty tubes.

The transporting of the peg trays 35 away from the machine takes place in a row closed to form a chain, and the peg trays 35 travel preferably to an automatic winding machine. A traversing rod 38, applied to the ring spinning machine and traversing according to the directions F and G serves to drive the peg trays 35 in transport direction P. At different points in longitudinal direction of the ring spinning machine, a forward feed member 39 engages in the open bottom of some trays 36, which forward feed member 39 moves periodically together with the traversing rod 38 in a known way. The forward feed member 39 is applied to a rocker 40 and this in turn to a joint 41 on the traversing rod 38.

The peg tray row travels during transporting away from the ring spinning machine to a monitoring station 25 connected to the ring spinning machine, whereby the wound on yarns 16 are to be monitored for hairiness. In the area of the monitoring station 25, a lifting element 42 is provided, which can be advanced to the respective tray 36 of a peg tray 35, and which can in this way raise the peg tray 35 together with the cop 45 to be monitored. A lifting rod 43 is arranged to the lifting element 42, which lifting rod 43 is movable according to the direction of motions H and I. In the case of the lifting rod 43, this can be, for example, the piston of a pneumatic or hydraulic cylinder.

As is known, the peg trays 35 do not move continuously in transport direction P, but rather periodically according to the traverse motion of the traversing rod 38. For each peg tray 35 there is a short dwell time between two periods. This dwell time is used to transfer the cop 45 to be monitored to an overhead monitoring position 46 in the monitoring station 25, see the dot-dash line. The lifting element 42 is here also moved into an upper position 44, also shown by a dot-dash line.

The monitoring of the hairiness at the cop 45 in the monitoring position 46 takes place, as experience has shown, at best at the upper conical edge 47, as it has been shown that in this area the hairiness is best recognized.

The monitoring position 46 of the cop 45 to be monitored is affixed by means of a take-up mandrel 48 of the monitoring station 25, which take-up mandrel is positioned above the cop 45. The tube arranged to the cop 45 is hereby clamped between the lifting element 42 in its upper position 44 and the take-up mandrel 48. During the monitoring process, the tube is rotated once, together with the cop 45 to be monitored, by means of a rotational drive 49 arranged at the monitoring station 25.

As can be seen, the digital camera 31 is directed towards a monitoring point of the cop 45 located in its monitoring position 46. The same monitoring point is illuminated by two light sources 50 and 51 at a predetermined angle in such a way that the light itself cannot enter the lens of the digital camera 31. After monitoring has been completed, the cop 45 is lowered, together with the peg-tray 35, into the peg tray row. The whole monitoring process must be completed before the peg tray row is moved forward a spacing by the forward feed member 39. After this forward feed movement, the next cop in transport direction P can be monitored.

The monitoring of the cop 45 and the removing of any faulty cops 64 (see FIG. 4) does not take place during one single dwell time, but rather at a plurality of dwell times. Thus at least a double dwell time is available for the execution of these two procedural steps.

Figure 4:
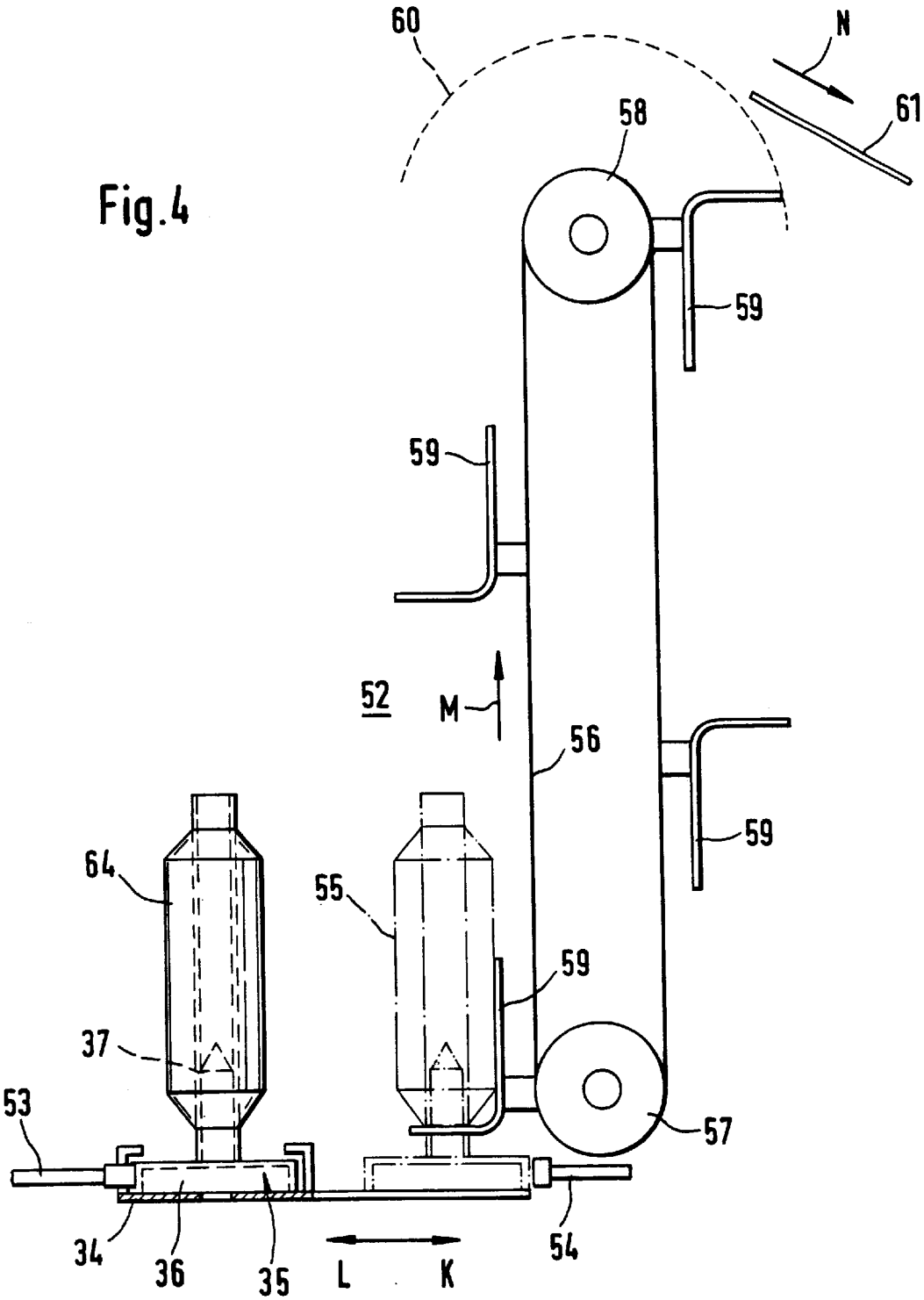
FIG. 4 is a cross-section through the peg tray row of FIG. 3 in the area of a cop removing station.

In FIG. 4, the cross-section of the longitudinal rail 34 can be seen, whereby a peg tray 35 is currently located at a cop removal station 52, arranged downstream of the monitoring station 25. This arranging of the monitoring station 25 and the cop removing station 52 is described below with the aid of FIG. 5 in more detail.

The cop removal station 52 as shown in FIG. 4 becomes only then effective, when a faulty cop 64 has been ascertained at the monitoring station 25. When this happens, an ejector element 53, which is movable transversely to the longitudinal rail 34, engages during a dwell time period and moves the peg tray 35 in the ejection direction K by a small amount. After the removal of the faulty cop 64, now in position 55, from the peg tray 35, the tray 36 is pushed back again into the peg tray row by means of a return thrust element 54 according to the thrust direction L. These two thrust movements must be carried out during a dwell period.

The cop 55, ejected laterally and denoted by a dot-dash line 55, is seized by a gripping element 59 and raised from the peg 37 of the peg tray 35 in lifting direction M. The gripping element 59 is L-shaped and forked on the supporting surface according to the tube diameter of the faulty cop 64.

An endless belt 56, or the like, serves the transporting away of the faulty cops 64, which endless belt 56 runs by means of two guiding wheels 57 and 58, one of which is driven. In the present case, four gripping elements 59 are applied to the endless belt 56. The faulty, gripped cops 64 are raised in lifting direction M and fed overhead by means of a chute 61 or the like according to the ejection direction N to a container. The generating curve of an envelope of the gripping element 59 is denoted by the number 60 and shown by a dot-dash line, and must be located outside of the chute 61.

With the aid of FIGS. 5A to 5I, the path of motion of a peg tray row in the area of a monitoring station 25 and a cop removal station 52 is very schematically described. The peg tray row is hereby considered from above, the individual peg trays 35 are just shown as circles. The FIGS. 5A to 5I represent a series of moments in time in the sequence of motion of a peg tray row.

Figures 5A, 5B, 5C, 5D, 5E, 5F, 5G, 5H, 5I:
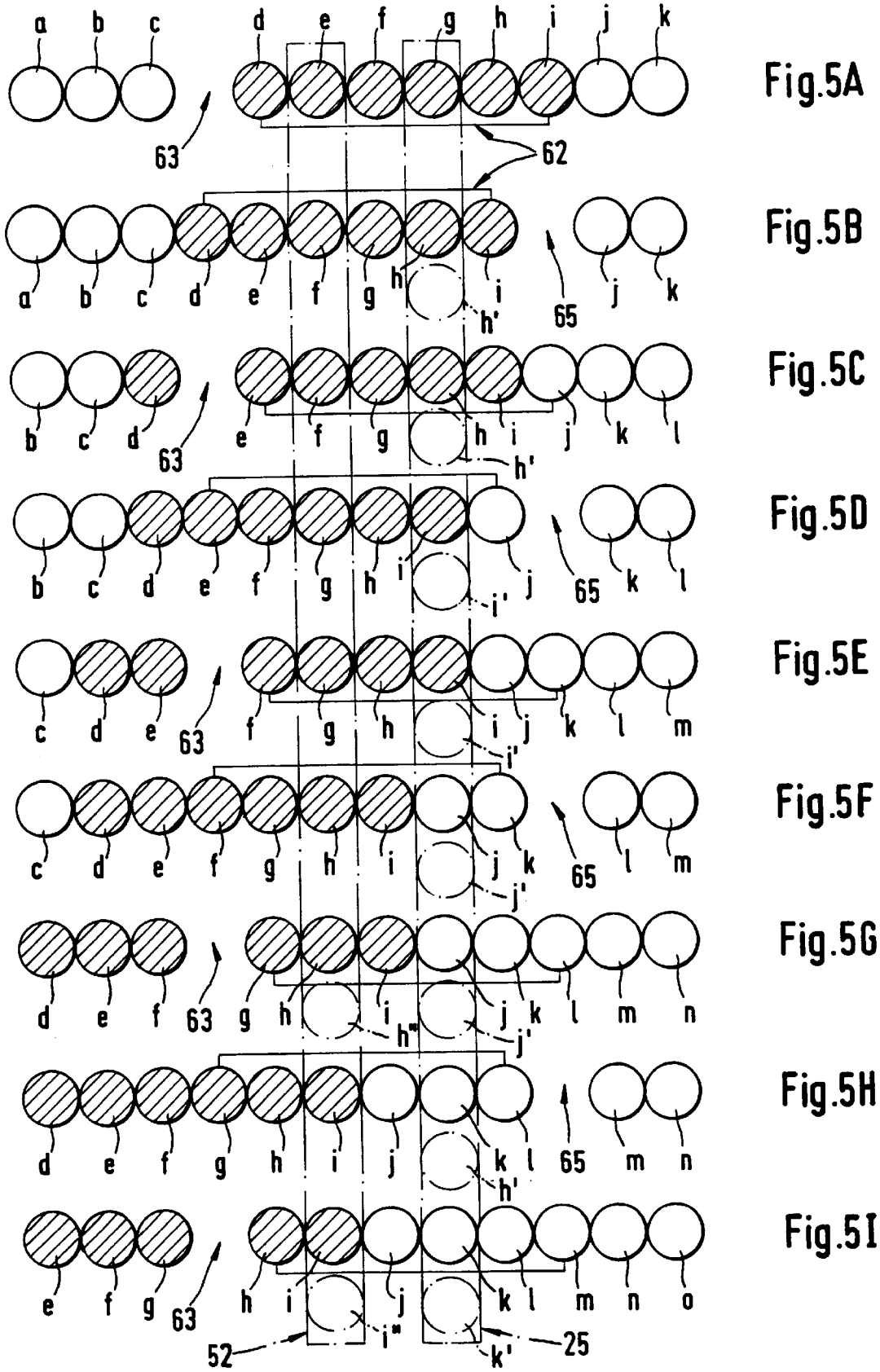
FIGS. 5A to 5I are schematic representations of the procedural stages at a peg tray row having a buffer zone operated in accordance with preferred embodiments of the invention.

In order to explain the scheme, the peg trays 35 arranged one behind the other in the peg tray row are denoted by small letters, in FIG. 5A by a to k. In addition, two dot-dash columns can be seen running through all the FIGS. 5A to 5I. The right column symbolizes the monitoring station 25, the left column the cop removal station 52. As already mentioned, the monitoring station 25 and the cop removal station 52 are spatially separated by a distance, so that the individual peg trays 35 reach the monitoring station 25 and the cop removal station 52 at different dwell times. Thus more time is available for carrying out the process.

In FIG. 5A, the presumed starting position of a peg tray row in the area of a monitoring station 25 and a cop removal station 52 is shown. In this area there is a buffer zone 62, which serves to extend the dwell time in the monitoring station 25 and in the cop removal station 52.

The peg tray row moves in FIG. 5A from right to left. The peg trays d to i are at this moment in the buffer zone 62. The peg trays d to i are denoted by a hatching to make them clearer. The peg trays d to i will continue to be denoted by this hatching for the sake of clarity, even after they have left the buffer zone 62.

As can be seen in FIG. 5A, there is a gap 63 in transport direction in the peg tray row downstream of the buffer zone 62. This gap 63 corresponds to a spacing, that is to the diameter of a peg tray 35. This gap 63 ensures that, in particular in the monitoring station 25, the dwell time for monitoring of the hairiness is considerably extended.

The peg trays located at this moment in the monitoring station 25, in the present case the peg trays d to i in FIG. 5A denoted by a crosshatching, are not connected with the normal traversing forward feed as described in FIG. 3, but rather to a separate rapid forward feed. The peg trays not denoted by a crosshatching, namely peg trays a to c and j and k, are connected to the normal peg tray forward feed, which is effected by the forward feed member 39 described above.

For the sake of completeness it should be mentioned that many more peg trays (not shown) have preceded the peg trays a to c shown in FIG. 5A, and that many more peg trays follow the peg trays j and k.

Subsequent to the presumed starting position according to FIG. 5A, the rapid forward feed is now activated, the result of which is shown in FIG. 5B. After the separate rapid forward feed has been activated, the previously existing gap 63 is closed, as the peg trays d to i are further transported as a packet by the amount of a spacing. In place thereof, another gap 65 has arisen between the peg trays i and j, which also corresponds to a spacing. During the rapid forward feed, the peg trays a to c and j and k, which are not denoted by a crosshatching, remain stationary.

Two advantages now occur:

On the one hand, due to the rapid forward feed, the dwell time is higher in this area, on the other hand, the gap 65 must only then be closed during subsequent normal forward feed of the peg trays a to c and j and k, before in particular the peg tray h located in the monitoring station 25 is moved again. Due to the buffer zone 62, which becomes effective because of the alternating gaps 63 and 65, the dwell time for the monitoring station 25 and for the cop removal station 52 is almost doubled.

After the rapid forward feed has been activated, that is, in the present position of the peg tray row according to FIG. 5B, the cop located on the peg tray h is now underneath the monitoring station 25, see here FIG. 3 again. The peg tray h can now be moved into the position h', denoted by a dot-dash line, that is raised as shown in FIG. 3, so that the monitoring of hairiness can begin already in the monitoring station 25. The subsequent analysis of the monitoring results in the computer of the digital camera 31 takes longer than the extended dwell time available, but analysis can be continued during a subsequent forward feed, as the peg tray h does not have to be present during the analysis itself.

Now the normal peg tray forward feed with the forward feed member 39, described in FIG. 3, comes into action again, the result of which is shown in FIG. 5C. The peg trays a to d are moved on by the amount of a forward feed spacing (the peg tray a is no longer visible in FIG. 5C). The peg trays j and k are also moved (as well as an additional peg tray 1 now becoming visible), so that the peg tray j is now adjacent to peg tray i. The peg trays e to j are now in the buffer zone 62. A gap 63 has occurred again in transport direction downstream of the buffer zone 62.

The monitoring of hairiness of the cop located on peg tray h'—see displaced position h'—can still be continued during this phase, and the peg tray h returns subsequently from the displaced position h' again into the peg tray row, so that subsequently the next rapid forward feed can take place. The analysis of the monitoring results continue on, however, during several forward feeds and is only then completed when the peg tray h has arrived in the cop removal station 52 after several forward feeds (see FIG. 5G below).

A rapid forward feed of the peg trays e to j located in the buffer zone 62 now takes place again, and the result thereof can be seen in the next FIG. 5D: the peg trays e to j have joined the peg tray d which is at the moment at a standstill, and thus the gap 63 is closed again. Instead, the intended gap 65 has occurred again upstream of the buffer zone 62, as the peg trays k and l were not moved. Now the displacement of the cop to be monitored, which is located on the peg tray i, can begin, see displaced position i'.

The next phase is again a normal forward feed of the peg tray row, whereby at the moment the peg trays f to j remain stationary. The peg tray k and the subsequent peg trays l and m form a gapless row, and in transport direction downstream of the buffer zone 62 a gap 63 is again present. The result can be seen in FIG. 5E.

The peg trays f to k are at the present moment in the buffer zone 62, and the cop to be monitored, which is located on the peg tray i, now finds itself in the monitoring station 25. Monitoring of the hairiness can be completed, whereafter the displaced peg tray i is guided back out of its displaced position i' into the peg tray row again.

The rapid forward feed now becomes active again, see the results in FIG. 5F. The peg trays f to k have now joined the currently stationary peg tray row where it was previously located, and again a gap 65 has arisen upstream of the buffer zone 62, as the peg trays l and m, which were connected to the normal forward feed, remained stationary. Displacement of the peg tray j in the displaced position j' can now begin.

The next phase, which is shown in FIG. 5G, brings with it a new step, in that now the peg tray h, whose cop has already been monitored, has reached the cop removal station 52. Due to the normal forward feed recurring, the results of which can be seen in FIG. 5G, the gap 63 has again occurred downstream of the buffer zone 62, as only the peg trays c to f were moved downstream of the buffer zone 62. The following peg trays l to n are now adjacent to the buffer zone 62. The monitoring of the cop located on the peg tray j can now be completed, whereafter the peg tray j is guided back into the peg tray row from the displaced position j'.

It is now assumed that a reading result is given, showing a faulty yarn 16 for the previously monitored cop (see FIGS. 5B and 5C) located on the peg tray h. As some time has passed since the monitoring in the monitoring station 25, the analysis of the computer 32 in the digital camera 31 is completed. In the cop removing station 52, the faulty cop located on the peg tray h can therefore be ejected, as described above with the aid of FIG. 4. As this ejection only then takes place when a faulty cop is actually present, the displaced position h" shown in FIG. 5G is denoted with a question mark. If the respective cop is not faulty, then nothing happens at the cop removing station 52.

For the sake of completeness, it is mentioned here that of course the peg tray h is guided back into the peg tray row after the removal of a faulty cop, as is described above with the aid of FIG. 4.

Now a rapid forward feed is due, the results of which are shown in FIG. 5H. The peg trays g to 1 have now joined the stationary peg trays d to f, and the gap 63 located there is closed again. Instead the other gap 65 has opened in transport direction upstream of the buffer zone 62, as the following peg trays m and n were not moved. The monitoring of the cop located on the peg tray k can now begin, see displaced position k'.

Now a normal forward feed takes place, which embraces the peg trays d to g as well as m to o, whereby the result can be seen in the last FIG. 5I. Instead of the previous gap 65, there is now a gap 63 between the peg trays g and h. The monitoring of the cop on the peg tray k is completed, and the peg tray moves from the displaced position k' back into the peg tray row. If a faulty cop is located on the peg tray i, it can be rejected in this phase in the cop removing station 52.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for monitoring quality of a ring spun yarn from a ring spinning machine with a condensing device at each of a plurality of spinning stations, comprising:

winding spun yarn from respective spinning stations onto cops, transporting the cops with spun yarn wound thereon away from the spinning machine, and automatically monitoring hairiness of the yarn on said cops during said transporting while rotating the cops during said monitoring.

2. A process according to claim 1, wherein the degree of hairiness along the entire contour of the cops is ascertained during said monitoring.

3. A process according to claim 2, wherein the cops rotate around their own axis in a monitoring station where said automatically monitoring occurs.

4. A process according to claim 2, wherein said automatically monitoring occurs at a monitoring station, and wherein a stream of air is passed over the cops in the monitoring station in order to make the hairs stand out.

5. A process according to claim 2, wherein the cops are guided through a monitoring station where said automatically monitoring occurs by a preferably sequenced transporting device.

6. A process according to claim 5, wherein a buffer zone having an extended dwell time is arranged at the monitoring station.

7. A process according to claim 2, comprising automatically sorting the cops based on the monitoring results.

8. A process according to claim 1, wherein the cops rotate around their own axis in a monitoring station where said automatically monitoring occurs.

9. A process according to claim 8, wherein said automatically monitoring occurs at a monitoring station, and wherein a stream of air is passed over the cops in the monitoring station in order to make the hairs stand out.

10. A process according to claim 1, wherein said automatically monitoring occurs at a monitoring station, and wherein a stream of air is passed over the cops in the monitoring station in order to make the hairs stand out during said monitoring.

11. A process according to claim 10, wherein the cops rotate around their own axis in the monitoring station.

12. A process according to claim 1, wherein the cops are guided through a monitoring station where said automatically monitoring occurs by a sequenced transporting device.

13. A process according to claim 12, wherein a buffer zone having an extended dwell time is arranged at the monitoring station.

14. A process according to claim 13, wherein a row of peg trays, forming a closed chain, is broken by a gap in the buffer zone, so that at this point the dwell time is extended.

15. A process according to claim 14, wherein a lifting element engages with the peg tray, which lifting element guides the peg tray to the monitoring station overhead and after the monitoring processes has been completed, lowers the peg tray again.

16. A process according to claim 15, wherein the peg tray is connected to a rotational drive during the monitoring for carrying out rotating of the cops during said monitoring.

17. A process according to claim 12, wherein a stream of air is passed over the cops in the monitoring station in order to make the hairs stand out during said monitoring.

18. A process according to claim 17, wherein a buffer zone having an extended dwell time is arranged at the monitoring station.

19. A process according to claim 1, wherein said monitoring is carried out by means of a monitoring station which travels along the length of the ring spinning machine.

20. A process according to claim 1, wherein the cops are classified according to their degree of hairiness to be used for different areas of application based on said monitoring.

21. A process according to claim 20, wherein the cops appearing unsuitable are removed.

22. A process according to claim 21, wherein faulty spinning stations determined during said automatically monitoring are retroactively identified and preferably indicated by means of a computer.

23. A process according to claim 1, comprising automatically sorting the cops based on the monitoring results.

24. A process according to claim 1, wherein said transporting includes guiding the cops away from the spinning machine on peg trays moving in sequence, wherein said monitoring is carried out at a monitoring station in an area of the peg trays, and wherein, during a dwell period of the sequenced transport, a peg tray containing cops to be monitored is advanced to the monitoring station.

25. A process according to claim 24, wherein a lifting element engages with the peg tray, which lifting element guides the peg tray to the monitoring station overhead and after the monitoring process has been completed, lowers the peg tray again.

26. A process according to claim 25, wherein the peg tray is connected to a rotational drive during the monitoring for carrying out rotating of the cops during said monitoring.

27. A process according to claim 24, wherein the peg tray is connected to a rotational drive during the monitoring for carrying out rotating of the cops during said monitoring.

28. A process according to claim 24, comprising removing a faulty cop from the peg tray by a gripping element arranged at the peg tray.

29. Apparatus for monitoring quality of a ring spun yarn from a ring spinning machine with a condensing device at each of plurality of spinning stations, comprising:

winding means for winding spun yarn from respective spinning stations onto cops, transporting means for transporting the cops with spun yarn wound thereon away from the spinning machine, and monitoring means for automatically monitoring hairiness of the yarn on said cops during said transporting while rotating the cops during said monitoring.

30. Apparatus according to claim 29, wherein the monitoring means includes means for monitoring the degree of hairiness along the entire contour of the cops is ascertained during said monitoring.

31. Apparatus according to claim 30, wherein the monitoring means includes means for monitoring the degree of hairiness along the entire contour of the cops is ascertained during said monitoring.

32. Apparatus according to claim 30, wherein the cops are guided by the transporting means through a monitoring station where said automatically monitoring occurs by a preferably sequenced transporting device.

33. Apparatus according to claim 32, wherein a buffer zone having an extended dwell time is arranged at the monitoring station.

34. Apparatus according to claim 30, comprising means for automatically sorting the cops based on the monitoring results.

35. Apparatus according to claim 29, wherein monitoring means includes a monitoring station, and wherein the cops rotate around their own axis in the monitoring station where said automatically monitoring occurs.

36. Apparatus according to claim 29, wherein said monitoring means includes a monitoring station, and comprising air stream means for passing a stream of air over the cops in the monitoring station in order to make the hairs stand out during said monitoring.

37. Apparatus according to claim 36, wherein means are provided for rotating the cops around their own axis in the monitoring station.

38. Apparatus according to claim 29, wherein the cops are guided by the transporting means through a monitoring station where are automatically monitoring occurs by a sequenced transporting device.

39. Apparatus according to claim 38, wherein a buffer zone having an extended dwell time is arranged at the monitoring station.

40. Apparatus according to claim 38, wherein air stream means for passing a stream of air over the cops in the monitoring station in order to make the hairs stand out during said monitoring.

41. Apparatus according to claim 40, wherein a buffer zone having an extended dwell time is arranged at the monitoring station.

42. Apparatus according to claim 29, wherein said monitoring is carried out by means of a monitoring station which travels along the length of the ring spinning machine.

43. Apparatus according to claim 29, comprising classifying means for classifying the cops according to their degrees of hairiness to be used for different areas of application based on said monitoring.

44. Apparatus according to claim 43, comprising means for removing the cops appearing unsuitable by said monitoring means.

45. Apparatus according to claim 44, comprising identifying means wherein faulty spinning stations determined during said automatically monitoring are retroactively identified and preferably indicated by means of a computer.

46. Apparatus according to claim 29, comprising means for automatically sorting the cops based on the monitoring results.

47. Apparatus according to claim 29, wherein said transporting means includes means for guiding the cops away from the spinning machine on peg trays moving in sequence, wherein said monitoring is carried out at a monitoring station in an area of the peg trays and wherein during a dwell period of the sequenced transport, a peg tray containing cops to be monitored is advanced to the monitoring station.

48. Apparatus according to claim 47, comprising a lifting element engageable with the peg tray, which lifting element guides the peg tray to the monitoring station overhead and after the monitoring process has been completed, lowers the peg tray again.

49. Apparatus according to claim 48, wherein the peg tray is connected to a rotational drive during the monitoring for carrying out rotating of the cops during said monitoring.

50. Apparatus according to claim 47, wherein the peg tray is connected to a rotational drive during the monitoring for carrying out rotating of the cops during said monitoring.

51. Apparatus according to claim 47, comprising a gripping element for removing a faulty cop from the peg tray.

* * * * *